US012134412B2

(12) United States Patent
Moloodi et al.

(10) Patent No.: US 12,134,412 B2
(45) Date of Patent: Nov. 5, 2024

(54) RAILROAD WELL CAR STRUCTURE

(71) Applicant: NATIONAL STEEL CAR LIMITED, Hamilton (CA)

(72) Inventors: Sina Moloodi, Mississauga (CA); Shayan Liaghat, Hamilton (CA); Mohammed Al-Kaabi, Hamilton (CA)

(73) Assignee: National Steel Car Limited, Hamilton (CA)

( * ) Notice: Subject to any disclaimer, the term of this patent is extended or adjusted under 35 U.S.C. 154(b) by 154 days.

(21) Appl. No.: 17/130,841

(22) Filed: Dec. 22, 2020

(65) Prior Publication Data

US 2022/0194438 A1 Jun. 23, 2022

(51) Int. Cl.

| | |
|---|---|
| ***B61D 3/20*** | (2006.01) |
| ***B61D 3/08*** | (2006.01) |
| ***B61D 3/18*** | (2006.01) |
| ***B61D 17/10*** | (2006.01) |

(52) U.S. Cl.

CPC ..... *B61D 3/20* (2013.01); *B61D 3/08* (2013.01); *B61D 3/187* (2013.01); *B61D 17/10* (2013.01)

(58) Field of Classification Search

CPC ... B61D 3/00; B61D 3/06; B61D 3/08; B61D 3/16; B61D 3/166; B61D 3/187; B61D 3/20; B61D 5/06; B61D 9/08; B61D 17/00; B61D 17/10; B61D 45/007

See application file for complete search history.

(56) References Cited

U.S. PATENT DOCUMENTS 1,696,332 A 12/1928 Sheehan
3,410,227 A * 11/1968 Gutridge ..... F16F 9/092 410/73
4,703,699 A * 11/1987 Hill ..... B61F 1/04 105/418
4,782,762 A 11/1988 Johnstone et al.
4,805,539 A 2/1989 Ferris et al.
4,889,055 A 12/1989 Jamrozy et al.
4,893,567 A * 1/1990 Hill ..... B61F 1/04 410/52

(Continued)

FOREIGN PATENT DOCUMENTS

EP 1985516 A2 * 10/2008 ..... B61D 3/16

OTHER PUBLICATIONS

Model Photo No. 1.

(Continued)

*Primary Examiner* — S. Joseph Morano
*Assistant Examiner* — Cheng Lin
(74) *Attorney, Agent, or Firm* — Hahn Loeser & Parks LLP; Nathan B. Webb

(57) ABSTRACT

A well car for carrying shipping containers has a pair of end structures supported by railcar trucks, a pair of first and second spaced apart side beams extending between the end structures and a well defined therebetween. Container support cross-members are mounted between the side sills in a position to support an end of a shipping container load carried within the well. An array of elongate members is provided to divide the opening into smaller spaces and to prevent excessively large openings from being left. The elongate members can have different forms, whether rigid hollow structural sections, rods, or cables. The arrays of elongate members are oriented at oblique angles along the railcar body.

28 Claims, 9 Drawing Sheets

(56) References Cited

U.S. PATENT DOCUMENTS

| | | | | |
|---|---|---|---|---|
| 4,905,608 | A * | 3/1990 | Terlecky | B61D 3/20 105/422 |
| 5,001,990 | A | 3/1991 | Pavlick | |
| 5,074,725 | A | 12/1991 | Pavlick | |
| 5,279,230 | A | 1/1994 | Thomas et al. | |
| 5,379,702 | A | 1/1995 | Saxton et al. | |
| 5,423,269 | A | 6/1995 | Saxton et al. | |
| 5,611,285 | A | 3/1997 | Saxton | |
| 5,743,191 | A | 4/1998 | Coslovi | |
| 6,148,965 | A * | 11/2000 | Forbes | B60T 13/266 105/3 |
| 6,196,137 | B1 * | 3/2001 | Forbes | B61D 3/184 105/418 |
| 6,354,778 | B1 * | 3/2002 | Coslovi | B61D 45/007 410/70 |
| 6,584,912 | B2 | 7/2003 | Forbes | |
| 6,704,991 | B1 | 3/2004 | Coulborn et al. | |
| 6,866,452 | B2 * | 3/2005 | Khattab | B61D 45/007 410/70 |
| 7,954,437 | B2 | 6/2011 | Miller | |
| 8,291,592 | B2 | 10/2012 | Saxton et al. | |
| 8,757,067 | B2 | 6/2014 | Miller | |
| 8,950,341 | B2 | 2/2015 | Boring et al. | |
| 8,973,508 | B2 * | 3/2015 | Al-Kaabi | B61D 3/14 105/355 |
| 10,300,931 | B2 | 5/2019 | Boring et al. | |
| 2001/0010198 | A1 | 8/2001 | Forbes | |
| 2003/0029353 | A1 | 2/2003 | Coulborn et al. | |
| 2007/0256589 | A1 | 11/2007 | Bell | |
| 2008/0282929 | A1 | 11/2008 | Miller | |
| 2012/0137925 | A1 | 6/2012 | Miller | |
| 2013/0255533 | A1 | 10/2013 | Boring et al. | |
| 2014/0305332 | A1 | 10/2014 | Miller | |
| 2014/0313969 | A1 | 10/2014 | Kalhan et al. | |
| 2015/0232106 | A1 | 8/2015 | Boring et al. | |
| 2016/0288803 | A1 | 10/2016 | Boring et al. | |
| 2019/0047595 | A1 | 2/2019 | Sivakumar et al. | |
| 2020/0062281 | A1 | 2/2020 | Brown et al. | |

OTHER PUBLICATIONS

Model Photo No. 2a & 2b Well Car.
Model Photo No. 3.
Model Photo No. 4.
Model Photo No. 5.
Model Photo No. 6.
Model Photo No. 7.
Railcar Photo No. 1.
Railcar Photo No. 2.
Railcar Photo No. 3.
Railcar Photo No. 4.
Railcar Photo No. 5.
Railcar Photo No. 6.

* cited by examiner

RAILROAD WELL CAR STRUCTURE

FIELD OF THE INVENTION

This invention relates to railroad freight cars, and more particularly to a railroad well car having cross-beams for supporting lading carried in the well car.

BACKGROUND OF THE INVENTION

Railroad well cars may be seen as having a pair of deep, spaced apart, parallel beams, with cross-members extending between the beams to form a support frame, or floor, for lading. The ends of the deep beams are mounted to end structures, which in turn are supported on a pair of railcar trucks. Although single unit well cars are still common, it is common to find articulated, multi-unit railcars that permit a relatively larger load to be carried on fewer trucks. The cross section of the railcar is generally defined by the pair of spaced apart left and right hand deep side beams, and structure between the side sills of the side beams to support such lading as may be placed in the well.

Contemporary well cars may carry a number of alternative loads made up of containers in International Standards Association (ISO) sizes or domestic sizes, and of highway trailers. The ISO containers are 8'-0" wide, 8'-6" high, and come in a 20'-0" length weighing up to 52,900 lbs., or a 40'-0" length weighing up to 67,200 lbs. Domestic containers are 8'-6" wide and 9'-6" high. Standard lengths of domestic containers are 45', 48' and 53'. Domestic containers have a maximum weight of 67,200 lbs. Recently 28' long domestic containers have been introduced in North America. The 28' containers have a maximum weight of 35,000 lbs. The shipping containers of 20 ft., 28 ft, or 40 ft lengths are placed in the well, with other shipping containers stacked on top in a "double-stack" configuration.

A well car withstands three kinds of loads. First, it faces longitudinal draft and buff loads, particularly those loads that occur during slack run-ins and run-outs on downgrades and upgrades. Second, it supports a vertical load due to the trailers or shipping containers it carries. Third, it faces lateral loading as the well car travels along curves and switch turn-offs.

The combined compressive longitudinal loads alone, or in combination with the effect of the vertical container loads tend to urge the top chords to buckle. Typically under compressive loading the top chords of the side beams tend to move laterally inboard relative to the bottom chords. One way to address this tendency is use moment resisting cross-members as shown and described in U.S. Pat. No. 7,334,528 of Dr. Mohamed Khattab, in which the cross-member transmits moments at connections to both side sills. The floor structure of a container carrying well car may include lading bearing cross-members such as described in U.S. Pat. No. 7,334,528 (a) at the ends of the well in the 40 foot container pedestal positions, and (b) in the middle of the well in the form of a central cross-beam to support containers at the 20 foot position. These vertical load bearing cross-members support the shipping container corners.

The floor structure may also include diagonal members to carry shear loads between the side beams.

SUMMARY OF THE INVENTION

In an aspect of the invention there is a railroad well car body unit. It has a pair of first and second side beams. The side beams extend lengthwise between first and second railcar end sections that are mounted to railcar trucks for rolling motion in a longitudinal direction along railroad car tracks. The railroad well car has a well defined between the side beams and the first and second railcar end sections. First and second container support cross-beams extend cross-wise between the first and second side beams. An intermediate container support cross-beam is located between and spaced from the first and second container support cross-beams. The first and second container support cross-beams have container indexing fittings upon which to locate shipping containers. An array of struts extend between, and are mounted to, the first and second side beams; the array including at least a first strut and a second strut. The first strut has a first end mounted to the first side beam and a second end mounted to the second side beam. The first strut is angled obliquely relative to the longitudinal direction.

In a feature of that aspect, the second strut has a first end mounted to the first side beam and a second end mounted to the second side beam and the second strut is angled obliquely relative to the longitudinal direction. In another feature, the first and second struts are angled relative to the longitudinal direction at angles of equal magnitude and opposite hand. In another feature, the first and second struts are next adjacent to each other. In still another feature, the first and second container support cross-beams each have a respective uppermost surface upon which to seat a shipping container. The first strut has an uppermost extremity. The uppermost extremity of the first strut lies at a lower height than do the respective uppermost surfaces of the first and second cross-beams. In a further feature, the railroad well car is free of cross-ties. In still another feature, the first and second container support cross-beams are mounted to the first and second side beams at moment connections. In an additional feature, the first container support cross-beam has a vertical through-thickness. The first strut has a vertical through-thickness. The vertical through-thickness of the first strut is less than the vertical through-thickness of the first container support cross-beam. In still another feature, the well car body unit has an open bottom and the array of struts is spaced along the body unit and limits opening passages through the open bottom to under 30 sq. ft. In yet another feature, the well car body unit has an open bottom and the array of struts limit opening passages through the open bottom to obstruct any object having dimensions greater than ft×8 ft.

In another aspect, there is a railroad well car body unit. It has a pair of first and second side beams. The side beams extend lengthwise between first and second railcar end sections mounted to railcars trucks for rolling motion in a longitudinal direction along railroad car tracks. The railroad well car has a well defined between the side beams and the end sections. First and second container support cross-beams extend cross-wise between the first and second side beams. An intermediate container support cross-beam is located between and spaced from the first and second container support cross-beam. The first and second container support cross-beams having container indexing fittings upon which to locate shipping containers. Bracing is mounted along the well car body between the side beams, the bracing including an array of elongate members, the elongate members including tension members.

In a feature of that aspect the tension members are tension rods. In another feature, the tension rods are oriented obliquely relative to the longitudinal direction. In a further feature, the tension members include cables. In another feature, the cables are strung across the well at oblique angles relative to the longitudinal direction. In still another feature, the cables are string back and forth across the well between a set of fairleads mounted to the side beams. In another feature, the first and second container support cross-beams each have a respective uppermost surface upon which to seat a shipping container. The first tension member has an uppermost extremity. The uppermost extremity of the first tension member lies at a lower height than the respective uppermost surfaces of the first and second cross-beams. In still another feature, the bracing includes cables and at least one of the cables passes under the first container support cross-beam. In another feature, one of: (a) the tension members are rods, and the rods are pre-tensioned; and (b) the tension members are cables, and the cables are pre-tensioned. In still another feature, the tension members are mounted in a criss-crossing arrangement.

In another feature, the first and second container support cross-beams each have a respective uppermost surface upon which to seat a shipping container. The bracing has an uppermost height; and the uppermost height of the bracing lies at a lower height than do the respective uppermost surfaces of the first and second cross-beams. In another feature, the railroad well car is free of cross-ties. In still another feature, the first and second container support cross-beams are mounted to the first and second side beams at moment connections. In a further feature, the first container support cross-beam has a vertical through-thickness. The bracing has a vertical through-thickness. The vertical through-thickness of the first strut is less than the vertical through-thickness of the first container support cross-beam. In a still further feature, the well car body unit has an open bottom and the array of struts is spaced along the body unit and limits opening passages through the open bottom to under 30 sq. ft. In till yet another feature, the well car body unit has an open bottom and the array of struts limit opening passages through the open bottom to obstruct any object having dimensions greater than 2½ ft×7 ft.

In another aspect there is a railroad well car body unit. A pair of first and second side beams, the side beams extending lengthwise between first and second railcar end sections mounted to railcars trucks for rolling motion in a longitudinal direction along railroad car tracks. The railroad well car has a well defined between the side beams and the end sections. First and second container support cross-beams extend cross-wise between the first and second side beams. An intermediate container support cross-beam is located between and spaced from the first and second container support cross-beam. Cross-bracing is mounted along the well car body between the side beams. The cross-bracing includes an array of elongate members extending in an obliquely angled criss-crossing pattern along the well.

DETAILED DESCRIPTION

Figure 1A:
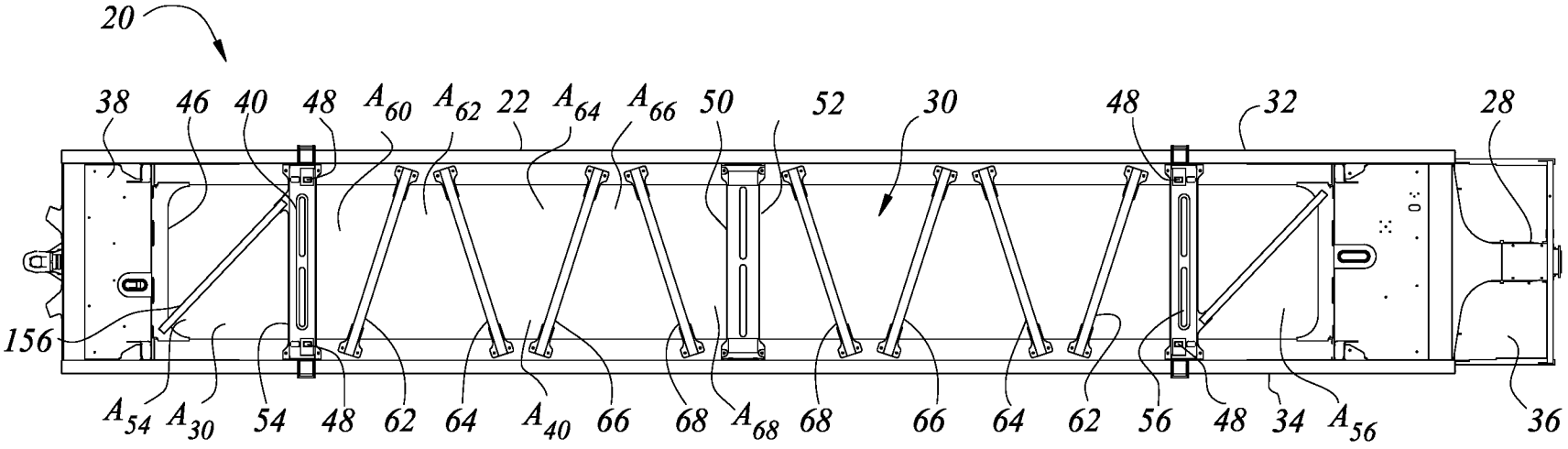
FIG. 1*a* is a general arrangement top view of a railroad well car unit of the present invention.

The description that follows, and the embodiments described therein, are provided by way of illustration of an example, or examples of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings may be taken as being to scale unless noted otherwise.

The terminology in this specification is thought to conform to the customary and ordinary meanings of those terms as they would be understood by a person of ordinary skill in the railroad industry in North America. Following from decision of the CAFC in Phillips v. AWH Corp., the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with In re Lee, (for example, earlier publications by persons not employed by the USPTO or any other Patent Office), demonstrating how the terms are used and understood by persons of ordinary skill in the art, or by way of expert evidence of a person or persons of at least 10 years' experience in the industry in North America.

In terms of general orientation and direction, for railroad car body units described herein the longitudinal direction is defined as coincident with the rolling direction of the railroad car when on tangent (that is, straight) track. In a Cartesian frame of reference, this is the x-axis, or x-direction. The longitudinal direction is parallel to the center sill, and parallel to the top chords and side sills. Unless otherwise noted, vertical, or upward and downward, are terms that use top of rail, TOR, as a datum. In a Cartesian frame of reference, this may be defined as the z-axis, or z-direction. In the context of the railroad car as a whole, or any car body unit thereof, the term lateral, or laterally outboard, or transverse, or transversely outboard refer to a distance or orientation relative to the longitudinal centerline of the railroad car, or car body unit, or of the centerline of a centerplate at a truck center. In a Cartesian frame of reference this may be referred to as the y-axis or y-direction. Given that the railroad car or railroad car body units described herein may tend to have both longitudinal and transverse axes of symmetry, unless noted otherwise, a description of one half of the car may generally also be intended to describe the other half as well, allowing for differences between right hand and left hand parts. As such, the term "longitudinally inboard", or "longitudinally outboard" is a distance taken relative to a mid-span lateral section of the car, or car unit. Pitching motion is angular motion of a railcar unit about a horizontal axis perpendicular to the longitudinal direction (i.e., rotation about an axis extending in the y-direction). Yawing is angular motion about a vertical or z-axis. Roll is angular motion about the longitudinal, or x-axis. Given that the railroad car described herein may tend to have a longitudinal axis of symmetry, a description of one half of the railcar generally also describes the other half, allowing for right-hand and left-hand parts. The abbreviation kpsi, if used, stands for thousands of pounds per square inch. Where this specification or the accompanying illustrations may refer to standards of the Association of American Railroads (AAR), such as to AAR plate sizes or lading rules, those references are to be understood as at the earliest date of priority to which this application is entitled. Unless otherwise noted, it may be understood that the railroad cars described herein are of welded steel construction.

Railroad well cars are the predominant car type for carrying intermodal shipping containers. They are sometimes supplied as single, stand-alone units, and are sometimes supplied as multiple body unit railcars, whether as a two-pack, three-pack, or five-pack car. Whether the railroad car has a single body unit, or includes multiple body units, those body units, however many, are ultimately carried on railroad car trucks for rolling motion along railroad car tracks. The body unit has a central well that is carried between a pair of first and second end sections. The first and second end sections are joined together by a pair of first and second side beams. The first and second side beams are spaced laterally apart and form the outside walls of the railcar. In a railroad car that has a single body unit, the end sections will each have a main body bolster that mounts over a railroad car truck. In the case of an end unit of a multiple body unit car, one end will have a main bolster than mounts over a truck, and the other end will have an articulated connector that engages with a mating articulated connector over a shared truck. In the case of an inner unit of a railroad well car having at least three body units, both ends of the car body unit have articulated connectors that mate with mating articulated connectors of adjacent car body units over a shared truck. In each case, the first and second end sections of the car body unit and the first and second side bean of the car body unit co-operate to form four sides of the well of the well car. This discussion is intended to apply to well car body units generally, whether they are stand-alone single units or units of a multi-unit car.

The side beams transmit longitudinal buff and draft loads, to carry the vertical bending loads of the lading, and lateral bending loads in curving. Reference is made to the well car floor or floor assembly. Although the term "floor" is used, the railcar bottom is largely open. The total opening area of the "floor" is bounded laterally by the horizontal legs of the side sills, and the bottom flanges of the end bulkheads at the body ends. The floor structure tends to be, and in all examples described herein is, non-continuous. Rather, it includes cross-members placed to support the corner castings of the inter-modal containers. The well car floor of a well car serves the following functions: (a) first, it handles in-service loads by acting as a truss to stiffen the car body structure when the car body is exposed to lateral loads. It prevents the side beams of the car body unit from buckling or deforming excessively during normal service loads. (b) The floor provides emergency container breakout protection. This tends to prevent derailments and other possible damage to the rail infrastructure, and to the train consist, in case of a container failure. The main AAR requirements are (a) that the number of members spanning the width of the car shall be provided to ensure no container floor area greater than 30 square ft is open to the ground; and (b) the floor structure is to be capable of supporting a 2½ ft×7 ft pallet of 15,000 lbs, placed crosswise on the car at any location, without failure or deflection greater than 3" downward.

Reference is made herein to different kinds of cross-members. The terms cross-beam, cross-bearer, cross-tie, and strut may be used. Cross-bearers and cross-ties are forms of cross-beam. A cross-bearer is a beam that carries loading applied in a direction transverse to the long axis of the beam, e.g., a horizontal beam that extends laterally across the car that carries the vertical load of a container (or tacked containers) as lading. A cross-bearer is connected to the other structure of the railcar at one or more moment connections. It is possible to make container support cross-members that have pin-jointed connections at the side sills, or whose connections approximate pin-jointed connections for the purpose of structural analysis of vertical loads. However, the container support cross-members illustrated are understood to have moment connections between the ends of the cross-member and the side sills of the side beams of the car and to be a kind of cross-bearer. A cross-tie is a beam that extends across the car and that is designed to carry transverse loads, such a vertical load from a container. Both cross-bearers and cross-ties have non-trivial flexural moduli EI, where E is the Young's modulus and I is the second moment of area of the section relative to a particular axis. A non-trivial flexural modulus is a necessary requirement for the ability to carry a bending moment. A cross-bearer is able to transmit a bending moment to other structure by virtue of its built-in ends. A cross-tie is able to resist bending moments, and to resolve them into shear force at the ends of the cross-tie, but is not able to transmit a bending moment because the ends of a cross-tie are analyzed as pin-jointed connections. A strut is a member that it designed to carry loads in tension or compression, but is not expected to be subject to transverse loads or to transmit a bending moment. A cable or wire or filament is a member that is expected to carry loads in tension, but not in compression.

The term "elongate member" is also used herein. In general, the term "elongate" means an object that is longer than wide. However, in the context of this specification and claims, the term "elongate member" is used in contra-distinction to the terms "cross-beam", "cross-bearer", and "cross-tie", in the sense that where the term "elongate member" is used, it is being applied to a member, be it a strut, a pin-jointed rod such as a tie rod, or a strung cable, that (a) is not employed to either carry or transmit a bending moment; and (b) interacts with other members as if connected at pin-jointed connections. That is, in this description, an "elongate member" is defined as being a non-moment-transmitting member. These elongate members are not relied upon to have non-trivial flexural moduli. On the contrary, for the purposes of structural analysis their structural moduli, whatever non-zero values they may actually have, are taken as being or approximating nil, and particularly to where those values would be only a few percent (e.g., less than 5%) of the EI value of a cross-tie or cross-bearer. Whereas a cross-bearer or cross-tie may have an aspect ratio of length to depth in the range of 5:1 to 20:1, the term "elongate member" as used herein may refer to, and in the examples illustrated is referring to, members of higher length to thickness or length to diameter ratios in excess of 30:1, and which may be in the range of 50:1 to 200:1.

Figure 1B:
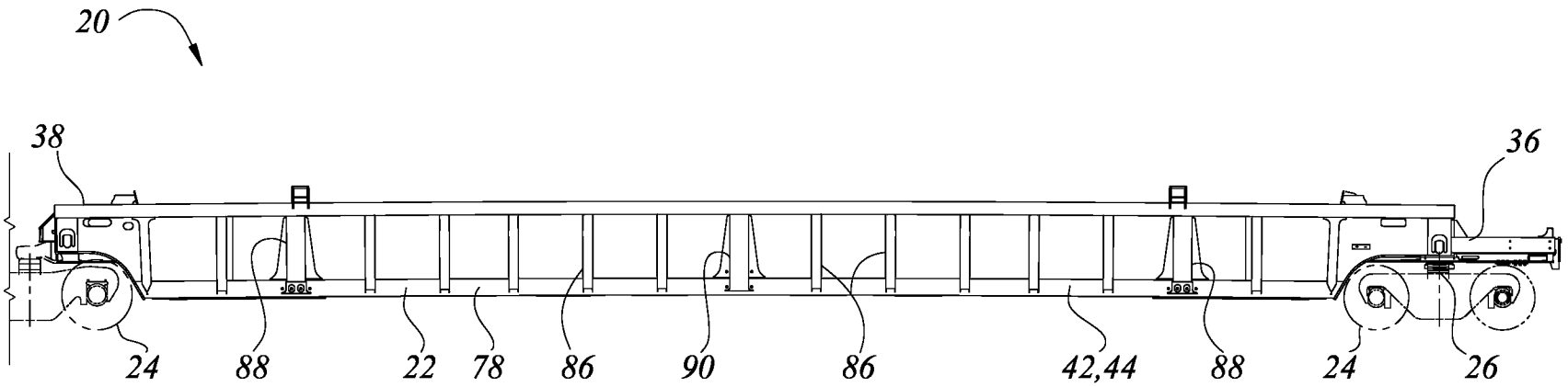
FIG. 1*b* is a side view of the railroad well car unit of FIG. 1*a;*
Figure 1C:
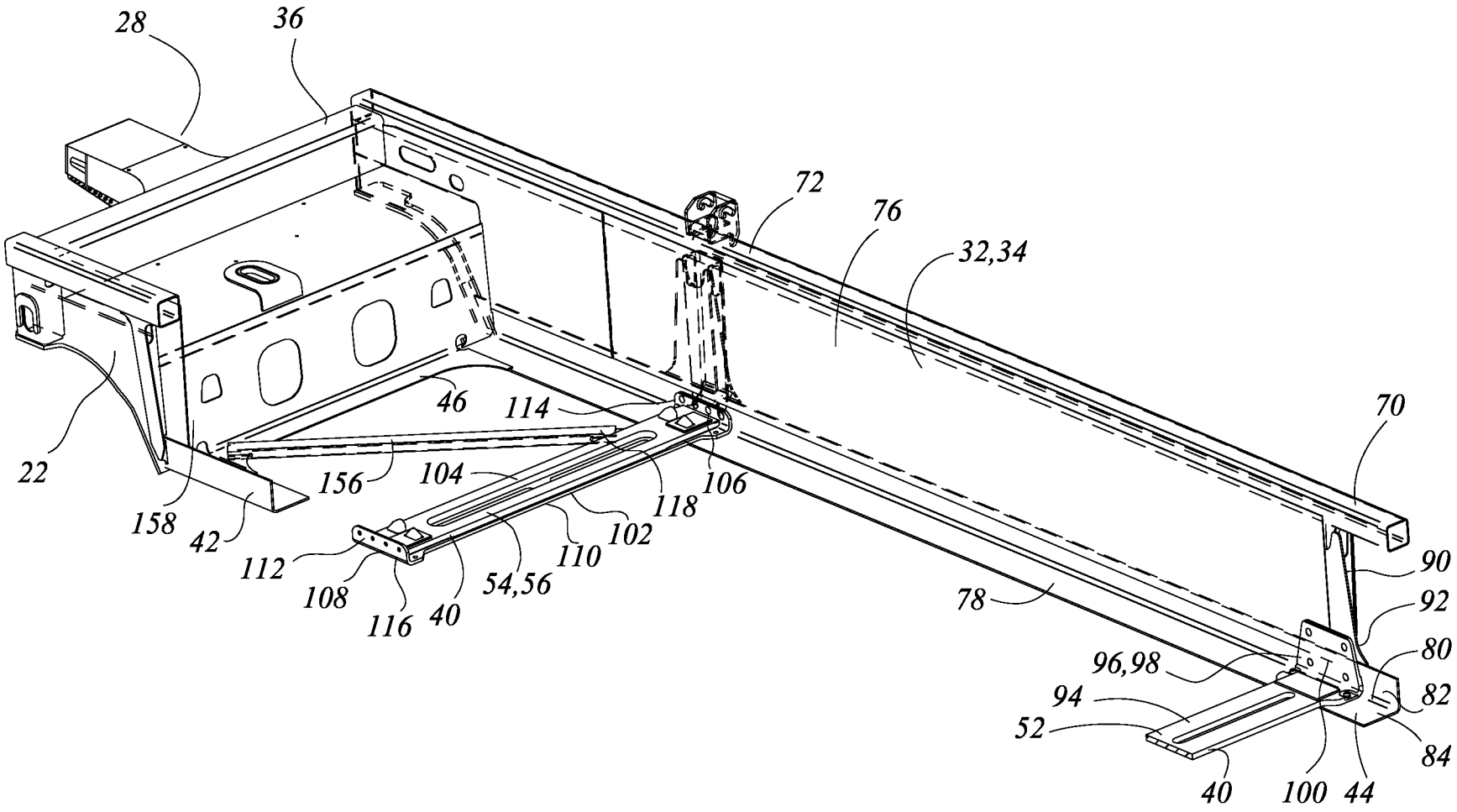
FIG. 1*c* is an exploded perspective scab view of the well car unit of FIG. 1*a* showing construction details thereof.

FIGS. 1*a*, 1*b* and 1*c* show a railroad well car, or well car unit, generally as 20. Other than as indicated, the major structural elements of car 20 are symmetrical about the longitudinal vertical plane of the car. Well car 20 has a railcar body unit 22 supported upon railcar trucks 24 for rolling motion in the longitudinal direction along the rails.

Railcar body unit 22 includes a pair of first and second, spaced apart end structures 36, 38 each mounted over a respective one of railcar trucks 24; and a pair of opposed, spaced apart, parallel first and second, longitudinally extending, deep side beam assemblies in the nature of left and right hand longitudinally extending side beams 32, 34. Side beams 32, 34 are mounted to extend between end structures 36, 38. A well 30 is defined longitudinally between end structures 36, 38. Side beams 32 and 34 define sides of well 30. End structures 36 and 38 each has a stub center sill 28 having a draft pocket defined at its outboard end for mounting a railway coupler or an articulated connector, as may be. A main bolster 26 extends laterally to either side of the stub sill. The distal tips of the main bolster are connected to the side beams. A shear plate overlies the end sill, and main bolster, and extends transversely outboard to mate with the side sills. The respective inner end of end structures 36, 38 may be defined by, or may include, an end bulkhead which forms the end wall of well 30. The end bulkhead may have a bottom flange 46 that extends inwardly toward well 30, bottom flange 46 being flush with, or substantially flush with, the respective bottom flanges of side sills 42, 44.

A floor or floor assembly 40, includes an array of cross-members 50 that includes a first structural cross-member shown as a main or central container support cross-beam 52 in the mid-span position that extends perpendicular to, and between, side sills 42, 44; and a pair of first and second end structural cross-beams identified as container support end cross-beams 54 and 56 located at the "40 foot" locations roughly 20 feet to either side (in the longitudinal direction of car 20) of cross-beam 52. The construction of cross-beams 52, 54 and 56 which join side sill assembly 42 to side sill assembly 44, is described in greater detail below. Container supports, or container locating cones 48 are located on end cross-beams 54 and 56. Cones 48 help to locate a container relative to cross-beams 54 and 56. The container support cross-beams 52, 54 and 56 are located so that the well 30 can accommodate either two 20-foot containers, each with one end located on cones 48 and the other end resting on center container support cross-beam 52, or a single 40 to 53 foot container, also located on cones 48 at either end. When supporting two 20-foot containers, an end of each container is supported by cross-beam 52. To accommodate these two container ends, cross-beam 52 is provided with load bearing portions of sufficient breadth to accommodate corner fittings of ends of two adjacent 20-foot shipping containers at the same time. That is, cross-beam 52 has a width at least as great as twice the width of the container corner fitting footprint plus an allowance for spacing between two adjacent containers carried back-to-back in the well. As such, cross-beam 52 carries, or is capable of carrying, approximately half of the load in this configuration. The weight supported by cross-beam 52 may be further increased if more than one level of cargo container is carried, such as when two containers are stacked on one another.

Within the allowance for longitudinal camber of car 20 generally, all container support cross-beam 52, 54, and 56 are understood to be parallel to, and generally coplanar with, one another. Floor assembly 40 may also include, and in the examples illustrate does include, intermediate cross-members 58, 60 and a set or array of diagonal braces, identified as cross-members 62, 64, 66 and 68. When installed, cross-beam 52 may be marginally higher than the other cross-beams 54, 56, and cross-members 58 and 60, such as may be. Cargo loads, such as intermodal cargo containers or other types of shipping containers carried by railcar 20, are intended to be supported by cross-beams 52, 54 and 56. That is, it is not intended that vertical container loads due to gravity should be borne by intermediate cross-members 58, 60 or by the diagonal braces, i.e., cross-members 62 to 68. Rather the lading may be held upwardly of them to tend not to be scraped or damaged by contact with the shipping container. This may nevertheless still tend to permit the relatively level loading of intermodal cargo containers which are raised at one end by container cones 48 located on end cross-beams 54 and 56. Central container support cross-beam 52 may be, and as shown is, equidistant from end container support cross-beams 54 and 56, being centrally located between them.

Description of Side Beams

Figure 2A:
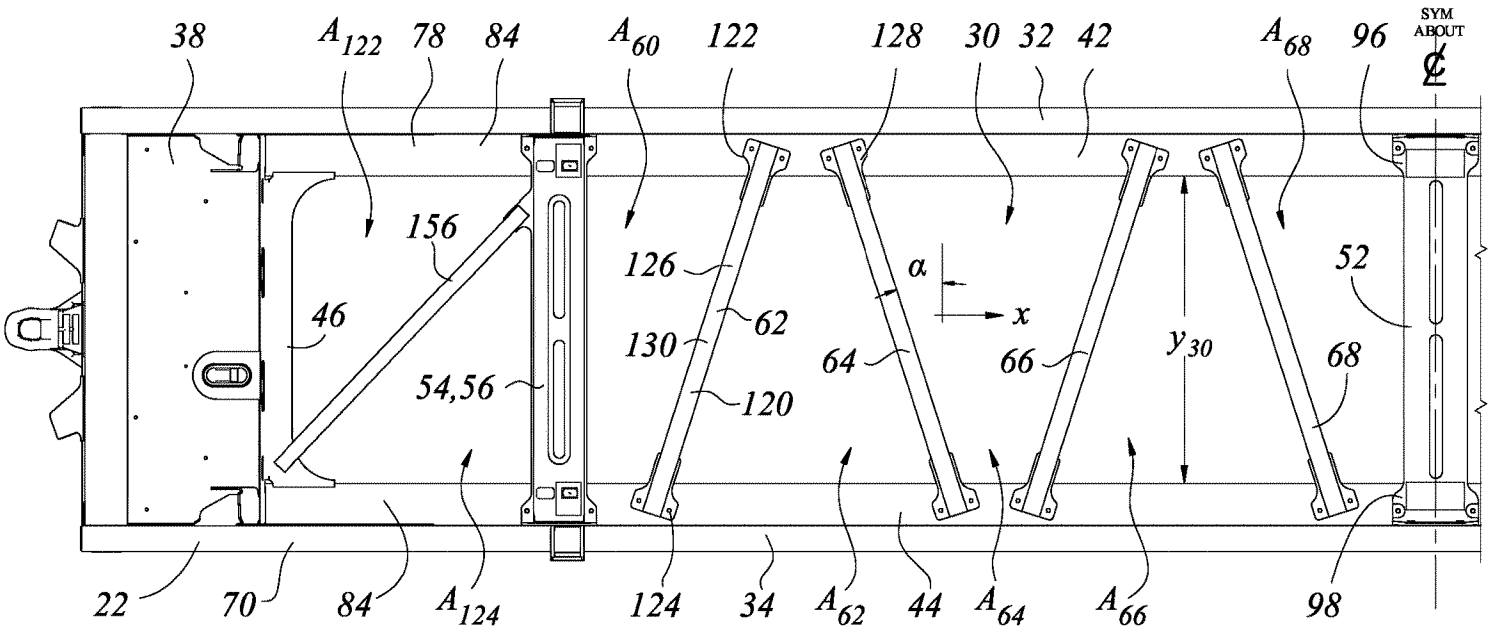
FIG. 2*a* is an enlarged view of the railroad well car unit of FIG. 1*a;*

For the purposes of this description, the structure of one side beam is the same as the structure of the other side beam such that a description of one side beam will serve also to describe the other. In FIGS. 2, 3, and 4, side beam 32 has an upper longitudinally extending structural member, namely top chord member 70 which has the form of a four-sided hollow tube 72. Hollow tube 72 may be a steel tube of square cross-section. A shear transfer member is identified as web 76. It is attached by a welded lap joint to, and extends downwardly from, the inner (i.e., laterally inboard) face of hollow tube 72. At its lower edge, web 76 is welded to a lower, longitudinally extending structural member in the nature of a side sill such as 42, 44, in the form of a bottom chord 78, preferably in the form of heavy angle 80. Bottom chord 78 has a vertical leg 82 to which web 76 is welded in a lap joint, and an inwardly extending toe or leg 84. In one example, the length of toe or leg 84 is such that the gap between it and the opposed toe or leg 84 of the other side sill may be less than 8'-0". In another example, the clearance may be less that 7'-0". As the gap is narrower than the container, the edge of toe or leg 84 may tend to lie roughly 6 inches inboard (and underneath) of the edge of an 8'-0" wide container, when loaded. That is, the spaced between the opposed distal ends of the respective horizontal flanges, or toes, or legs 84 of side sills 42, 44 toes are narrower than the 8 ft wide boxes, and so the box cannot pass between the toes. More formally, a vertical projection of the base area of the box cannot pass between the side sills.

Side beams 32, 34 each include an array of upright stiffeners, or posts 86, that extend between bottom chords 78, and top chords 70. Side posts 86 have the form of steel channel sections welded toes-inward along the outside face of side beams 32, 34. The legs of the channel section are tapered from a wide top to a narrower bottom. The back of the channel stands outwardly from web 76, and the toes of the channel abut web 76 to form a closed hollow section.

Side posts 86 may be located abreast of, i.e., at longitudinal stations of, the longitudinal stations of the junctions of intermediate cross-members 58, 60 and also at longitudinal stations intermediate to the longitudinal stations of the cross-beams and cross-ties, and longitudinally outboard of cross-beams 54, 56, as may be. The longitudinal pitch of the posts 86 may be about 40 inches from the next adjacent post.

End side post 88 is a tapered channel mounted to side beams 32, 34 at locations stations corresponding to the 40 foot container support positions, i.e., abreast of, the junctions of end cross-beams 54, 56 with bottom chords 78 of side sills 42, 44. Center side posts 90 each have the form of a fabricated tapered channel mounted toes-inward to side beams 32, 34 at locations corresponding to (that is, abreast of) the junctions of centre cross-beam 52 with side sills 42, 44 and, more particularly, with bottom chords 78 thereof to yield a moment connection at those locations as explained below.

Posts 88, 90 are of heavier section than side posts 86. Further, a reinforcing member smoothly profiled doubler plate 92, is mounted to the outboard face of web 76, and underlies the footprint of the toes of post 88, or post 90 as the case may be. Thus the local cross-section of the side sills at the location of reinforced posts 88, 90 at mid height between the top chord 70 and the bottom chord 78 has a higher second moment of area for resisting lateral flexure of the top chords 70 than intermediate side posts 86.

Cross-beam 52 is formed from a monolithic piece of rolled steel plate, having a medial, or spanning portion 94 terminating at either end in first and second end portions having end attachment fittings in the nature of upwardly bent toes 96, 98 having bolt holes for attachment to the side sills. When mounted in car 20, the long axis of cross-beam 52 extends transversely with respect to car 20 generally, that is, perpendicular to the central vertical plane of railroad well car 20. Spanning portion 94 has a generally rectangular shape and a substantially uniform thickness of about 1½". Spanning portion 94 of cross-beam 52 has a width of roughly 17½", sufficient to accommodate the ends of two intermodal cargo containers, used when two 20 foot cargo containers are loaded end-to-end in well 30 of the car body unit 22.

Although toes 96 and 98 could be machined from a solid block, as shown they are formed by heating a lateral bend area of center cross-beam 52, that area being proximate to each end of the center cross-beam 52. Cross-beam 52 is then bent from an initial state as a flat monolith in the nature of a flat bar or plate, of desired profile, to form bent toes 96, 98. As formed, when viewed from the side, cross-beam 52 has a U-shape.

Toes 96, 98 as shown each include an upwardly extending trapezoidal flange 100 of tapering thickness for connection to the generally vertical leg of side sills 42, 44. Toes 96, 98 taper from a relatively thick root at bend area to a thinner, chamfered distal tip. The outboard surface of flange 100 is stepped, having a first, or distal portion machined to present a planar surface normal to (i.e., perpendicular to) the long axis of cross-beam 52 which provide an attachment interface surface for mounting against the lower portion of side beam web 76. The outboard surface of cross-beam 52 has a machined chamfered step to accommodate the overlap of side beam web 76 on the inside face of upwardly extending leg 82 of bottom chord 78. The proximal portion provides another planar surface, in this case for placement directly against vertical leg 82 of bottom chord 78.

Flanges 100 are also wider at the proximal end (that is, closer to the bend of bend area). That is, the trapezoidal profile narrows from a wider base adjacent bend area to a narrower upper region at the distal tips. The attachment fittings each have a set of three countersunk through hole bore formed in distal portion, and an additional pair of first and second countersunk through hole bores formed in the proximal portion. The countersunk bores admit fasteners by which toes 96, 98 can be attached to side sills 42, 44 respectively by mechanical fasteners as opposed to welding. Although threaded fasteners such as high strength bolts or other fasteners such as rivets could be used, it is preferred to use Huckbolts™ for this connection.

Each end attachment fitting of cross-beam 52 has a pair of first and second machined ears, or lugs that extend to either side of a medial portion. The lugs have a machined upper surface for engagement by the head of a fastener, and a parallel machined lower planar surface providing an engagement interface for placement against the upper surface of inwardly extending leg 84. The rebate formed by machining the upper surface of the lugs lets the mechanical fastener seat shy of (that is, out of the way of items placed on) the plane of the upper surface presented by cross-beam 52 to the bottom of shipping containers. Rivets or other mechanical fasteners could be used, such as high strength Huckbolts™. This arrangement yields a moment connection of the cross-member to the side beam, forming a spring.

The upper surface of cross-beam 52 includes first and second end regions that present a container support interface in the nature of first and second planar surface portions of sufficient width to accommodate end corner fittings of two 20 foot containers carried end-to-end in well 30.

Cross-beam 52 is installed by inserting a fastener through the various bores to provide a rigid connection between cross-beam 52 and side beams 32, 34. The connections permit the transmission of moment between side beams 32, 34, cross-beam 52 and center post 90. While a welded connection could also be used, a mechanically fastened connection is used as shown. A bolted connection tends to reduce the likelihood of fatigue cracking at the connection. When installed, cross-beam 52 overlaps with inwardly extending leg 84 of bottom chords 78. This overlap permits bottom chord 78 to help support a vertical load placed on cross-beam 52, as when the load is placed on load bearing surface portions of cross-beam 52 for supporting a shipping container.

End Cross-Beams

End cross-members 54, 56 are identical in configuration, such that a description of one also describes the other. End cross-beam member 54, 56 includes a first beam member in the nature of a monolithic lower plate 102 and a second beam member in the nature of an upper plate 104 mounted to monolithic lower plate 102 to form a two-layered beam, or laminate, that is welded together. The welded layers co-operate to resist vertical flexure of the cross-member. The upper layer has lengthwise running slots of plate 104 that open onto the lower layer and yield a greater length of weld filet.

Lower plate 102 has first and second end portions 106, 108 and a medial portion 110 lying therebetween. Lower plate 102 has bent ends that form upwardly bent toes 114, 116 defining upwardly extending flanges 112 that mate with the inwardly facing surface of upwardly extending leg 82 of bottom chord 78. Bent toes 114, 116 each have mounting fittings in the nature of a set of four spaced apart countersunk through hole bores to for fasteners to connect toes 114, 116 to upward leg 82 of side sills 42, 44 of side beams 32, 34 respectively.

End portions 106, 108 also include a horizontal portion that, in plan view, has a wide portion and a narrower portion. The horizontal portion has a planar interface surface that seats upon the upper surface of inwardly extending toe or leg 84 of bottom chord 78. The wings lugs that each have a countersunk through bore by which cross-beam 54, 56 is fastened to bottom chord 78 by mating fasteners, such as Huck-bolts™. Alternatively, bolts and nuts or formed rivets could be used. The flat solid ends of plate 104 provide a land upon which container cones 48 are mounted. This structure bears a vertical compressive load at the container corner.

Four countersunk bores pass through each flange 112 for receiving fasteners to attach cross-beam 54, 56 to upwardly extending leg 82 of bottom chord 78. Although four bores are shown, as few as one bolted connection, or more than four bolted connections could be used.

Cross-member 54, 56 is attached by bolts to yield a rigid moment connection between cross-beam 56, side sill 42, 44, and end side post 88. The connection may be used to transmit a moment at the inwardly extending leg 84 of bottom chord 78. Moments may be effectively transferred between the structural elements of the railcar 20 in both the horizontal and vertical planes to resist deflection of the top chords 70 transverse to the longitudinal direction. Mechanical fastening facilitates removal and replacement of damaged or worn cross-members. The overlap of cross-beam 54, 56 over inwardly extending leg 84 of bottom chords 78 permits bottom chord 78 to help support a load placed on cross-beam 54, 56.

Cross-beam 54, 56 has an anchor plate or strut connection plate 118 mounted to extend outwardly from lower plate 102. Another strut connection plate 118 is mounted to extend from the opposite side of beam member 54, 56.

In well car body unit 22 of FIG. 2, the floor, or floor assembly, 40, has a set of braces or cross-members 120 that includes first, second, third and fourth diagonal cross-members 62, 64, 66 and 68. Cross-members 62, 64, 66 and 68 are arrayed between one or another of first and second end container support cross-members 54, 56 and center container support cross-beam 52. Cross-members 62, 64, 66 and 68 may be, and as shown are, spaced apart from container support cross-beam 52, 54 and 56 (as may be), and from each other.

Each cross-member 62, 64, 66, 68 has a first end 122, a second end 124, and a mid-portion 126 that extends between first end 122 and second end 124. As seen in FIG. 2, when viewed in cross-section, each cross-member 62, 64, 66 and 68 has an upper member formed of a channel 130 that is welded toes-down to a plate 128. Plate 128 is widened at its ends to form attachment ears that mate with horizontal leg 84 of side sill 42, 44. When combined, channel 130 and plate 128 co-operate to form a closed rectangular section in which the back of channel 130 and plate 128 are the upper and lower flanges, and the legs of channel 130 define the webs of the section.

As seen in FIG. 2, cross-members 62, 64, 66 and 68 attach to the side sill flange, namely leg 84. They do not attach to first or second end container support cross-beams 54, 56 or to intermediate container support cross-beam 52. As seen, cross-members 62, 64, 66 and 68 are not square to the side beams (or to the side sills of the side beams, or to the center-line, x-axis, or longitudinal rolling direction of the railroad car more generally). Rather they are oriented at an oblique angle. The complement of that angle is indicated as angle $\alpha$. Subtracting angle it from 90 degrees yields the oblique angle relative to the longitudinal Center line of the car. Moreover, each pair is oriented at alternating left-hand and right-hand angles. In the embodiment shown those angles are equal and opposite. Being angled in this manner, cross-members 62, 64, 66 and 68 function as shear transfer struts between side beams 32, 34, and, in combination with end container support cross-beams 54, 56 and container support cross-beam 52 co-operate to form a truss in which side beams 32, 34 define the flanges of the truss respectively for resistance to lateral bending of the car during curving. Cross-members 62, 64, 66 and 68 may be considered to be "elongate members", i.e., non-moment-transmitting members, as defined in this specification.

Moreover, the vertical through thickness of members 62, 64, 66, 68 is less than the vertical through thickness of cross-beams 52, 54, 56. The upper surface of cross-members 62, 64, 66, and 68 (i.e., the upper surface of the back of channel 130) is lower than the respective uppermost surfaces of cross-beams 54, 56, 52 upon which the intermodal container corner castings seat, such that, in use, the intermodal containers are supported in a higher plane and are discouraged from contacting cross-members 62, 64, 66 and 68. Reducing such contact reduces the likelihood of scraping or other damage that might otherwise be caused to cross-members 62, 64, 66 and 68 such as might result in corrosion or other unwanted degradation. That is, cross-members 62, 64, 66 and 68 are struts, rather than cross-ties or cross-bearers. In that context, car body 20 is free of cross-ties in the spaces between cross-beams 52 and 54, and 52 and 56, and is free of cross-ties generally.

Further still, the overall opening of the bottom of intermodal railroad car body unit 22 may be taken as the opening of the entire region of the bottom of well 30, from side sill to side sill, and from end bulkhead to end bulkhead, including the regions between end bulkhead bottom flanges 46 and first end container support cross-beams 54, 56 as may be. The overall bottom opening area of well 30 is designated as $A_{30}$. The areas between the end container support cross-members and the end bulkheads is designated as $A_{54}$ and $A_{56}$ respectively. There is also a sub-region of area $A_{30}$ that lies longitudinally between end cross-beams 54, 56, corresponding to the location that, in use, is largely occupied by a 40 ft. shipping container. That area is designated as area $A_{40}$, and is divided by the various cross-members into lesser openings $A_{60}$, $A_{62}$, $A_{64}$, $A_{66}$, and $A_{68}$. As shown, each of these sub-openings is less than 30 sq. ft. in size. In the embodiments shown the respective areas $A_{60}$ and Abs may be, and as shown are, about 18 sq. ft; and the respective areas $A_{62}$, $A_{64}$, and $A_{66}$ may be, and as shown are, about 27 sq. ft. In one embodiment each of the openings is too small to permit passage of a pallet measuring 2 ft.×8 ft. Further still, in the example illustrated each of these openings is too small to allow a pallet measuring 2½ ft.×7 ft. to pass therethrough. In that regard, cross-members 62, 64, 66 and 68 acts as, and may be alternately termed as being, arresters or retainers that prevent the escape of lading. They may also be termed "dividers" to the extent that they divide the area of the otherwise large opening of the bottom of the car (bounded by side sills 42, 44 and beams 52, 54 and 56, into smaller sub-portions or sub-regions.

Finally, the end regions of well 30 have a diagonal strut 156 mounted between the respective end container support cross-beam, be it 54 or 56, and the adjacent end bulkhead of well 30 of the respective end section $A_{122}$, $A_{124}$. In this instance $A_{122}$, and $A_{124}$ may be less than 20 sq. ft., and in one embodiment as shown are about 17 sq. ft. This configuration is seen and described in U.S. Pat. No. 7,334,528 of Dr. Khattab. The arrangement of end bulkhead bottom flange 46, side sill flanges, i.e., legs 84, cross-beams 54, 56 and struts 156 also leaves sub-openings of less than 30 sq. ft., and that will not admit passage of a pallet measuring 2 ft×7 ft, or larger.

Figure 2B:
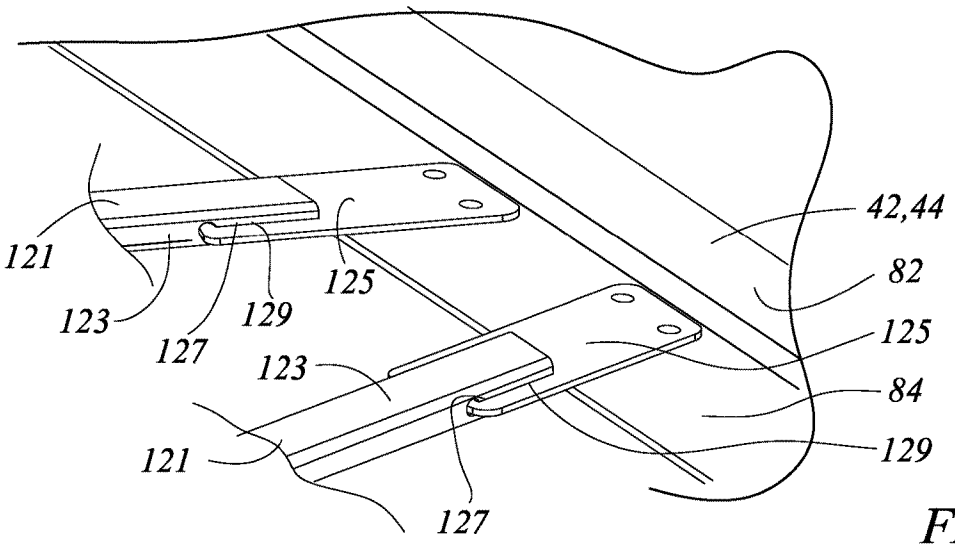
FIG. 2*b* is an enlarged detail of an alternate cross-member mounting for the railroad well car unit of FIG. 2*a;*

In the alternate detail of FIG. 2*b* there is a cross-member 121 formed from a rectangular steel tube. The ends 123 of the tube are mated to a mid-level plate 125. For that purpose end 123 has a cross-wise slot 127 formed in its webs. The end of plate 125 fits into slot 127, and welded in place, above and below, as fillets 129. As seen, the end of plate 125 has a pair of bores formed therein that mate with corresponding bores in the horizontal leg 84 of side sill 42, 44. On installation mechanical fasteners, e.g., Huck Bolts™ are used to mate the two together. By inserting plate 125 at the mid-level of the hollow rectangular tube of cross-member 121, the cross-member is reversible, such that there is no requirement to make alternating left-handed and right-handed parts.

Figure 3A:
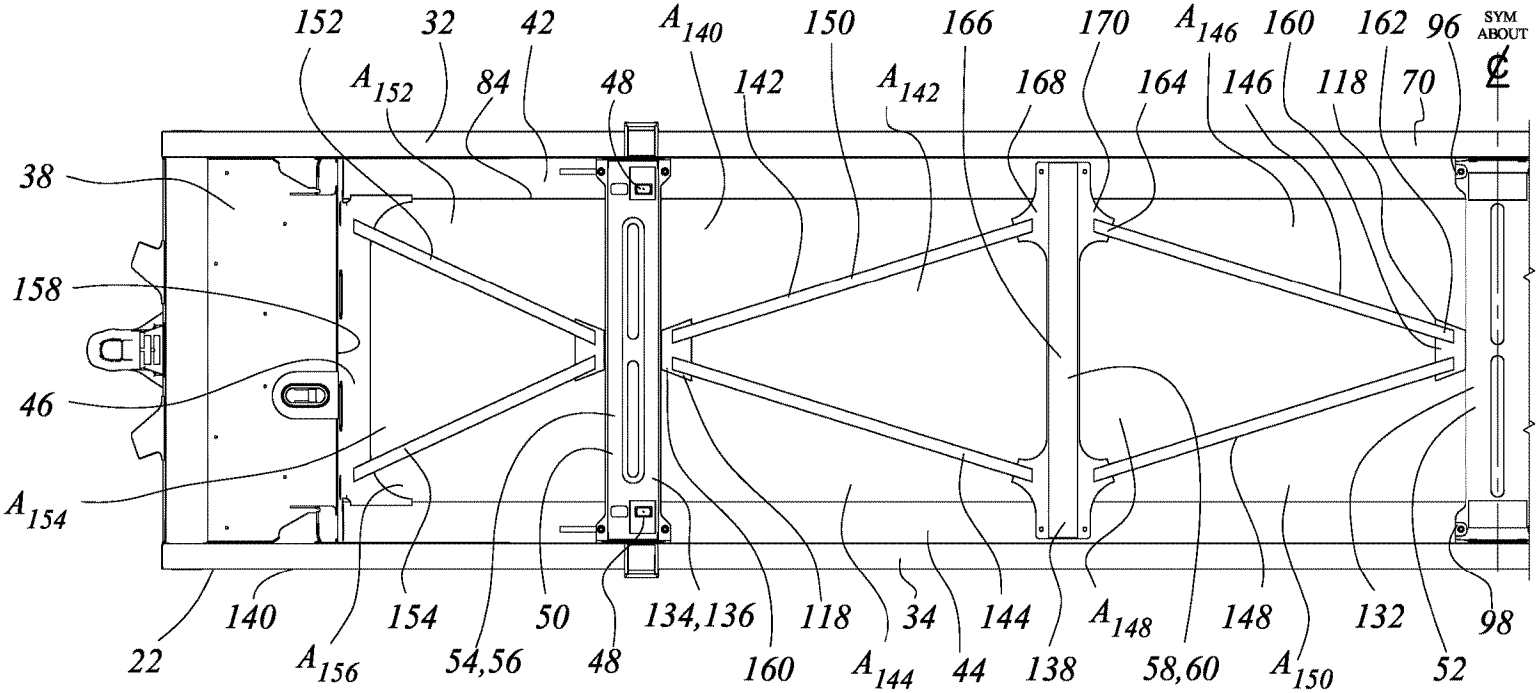
FIG. 3*a* is a top view of an alternate railroad well car to that of FIG. 2*a;*
Figure 3B:
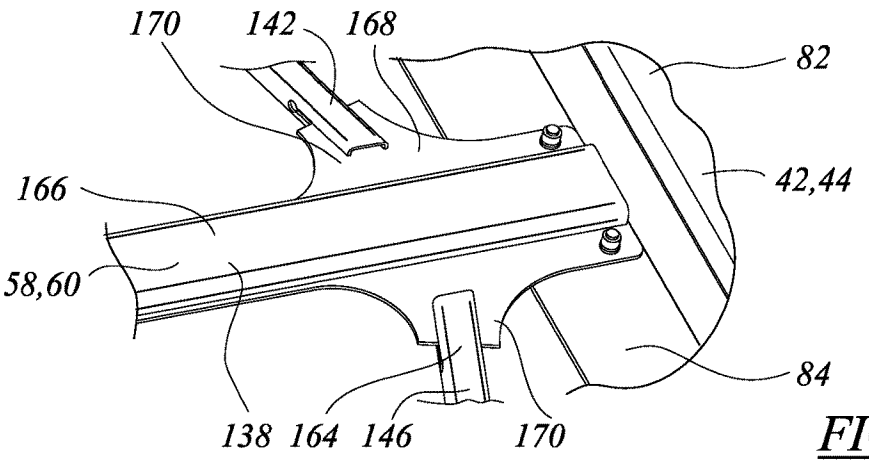
FIG. 3*b* is an enlarged detail of an arrangement of an intermediate cross-member mounting for the railroad well car of FIG. 3*a;*
Figure 4:
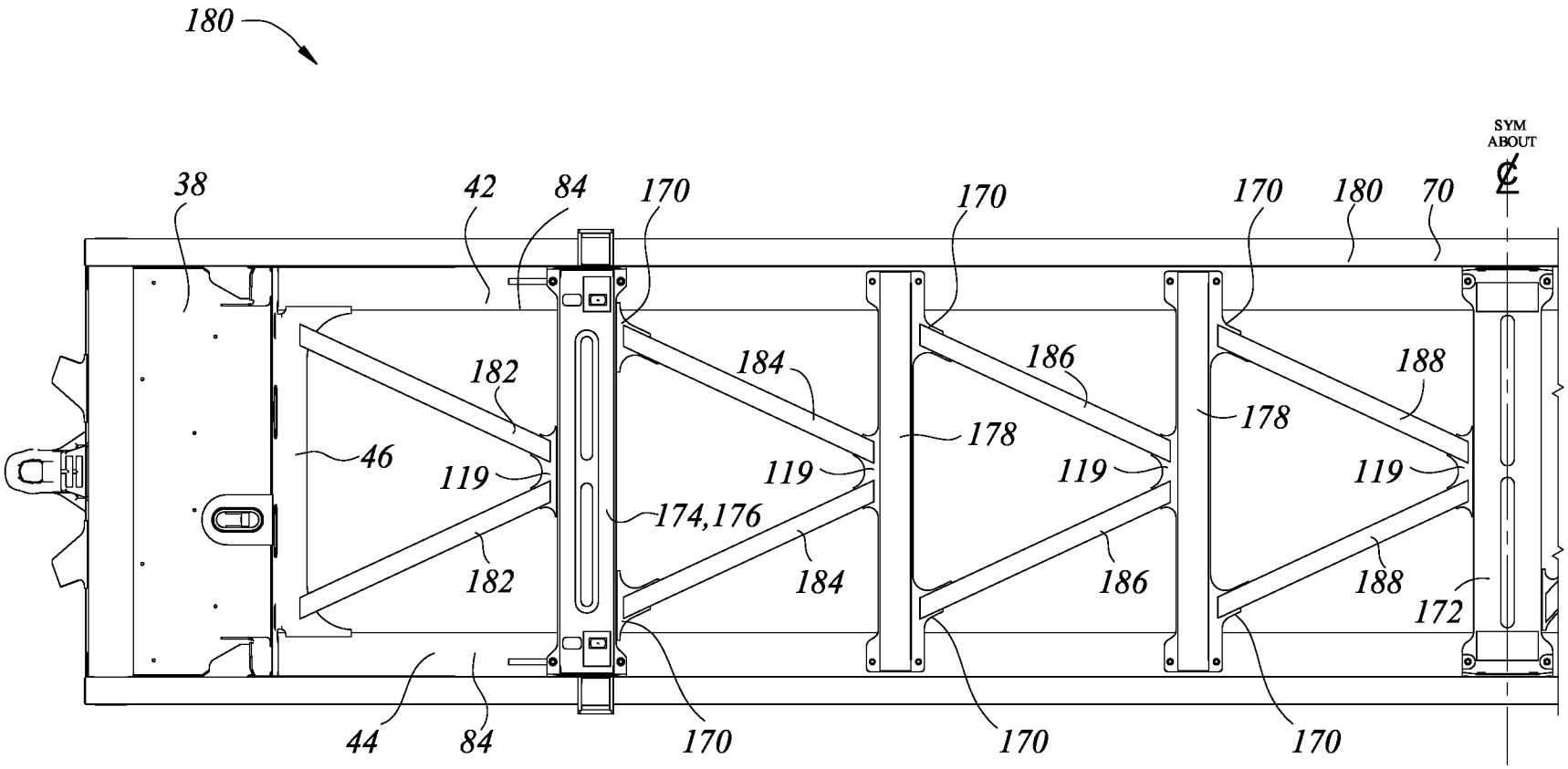
FIG. 4 is a top view of another alternate railroad well car to that of FIG. 2.

In FIGS. 3*a* and 3*b* there is an alternate railroad well car body unit 140. As before, it has side beams 32, 34 that may be understood to be of the same construction as previously described. In this instance, the floor assembly 40 has first and second end container support cross-beams 134, 136 and an intermediate container support cross-beam 132. It also has first and second cross-ties 138. A first cross-tie 138 is located intermediate center lading support cross-beam 132 and first end lading support cross-beam 134 and is shown equidistant from them; second cross-tie 138 is located intermediate center lading support cross-beam 132 and second lading support cross-beam 136, equidistant from them.

In this example, floor assembly 40 also has an array of elongated members 150 includes elongate members 142, 144, 146 and 148, and shorter elongate members 152, 154. Shorter elongated members 152, 154 extend from end bulkhead bottom flange 46 to the center of the first end container cross-beam 134. Elongate members 142, 144 are extend diagonally from the opposite lateral side of end container support cross-beam 134 to first cross-tie 138; elongate members 146, 148 extend diagonally between first cross-tie 138 and central container support cross-beam 132. Elongate members 142, 144, 146 and 148 may be, and as shown are, arranged in a diamond-shaped arrangement. They divide the bottom opening area of the car body into sub-regions or sub-portions, or sub-areas $A_{140}$, $A_{142}$, $A_{144}$, $A_{146}$, $A_{148}$, $A_{150}$, $A_{152}$, $A_{154}$, $A_{156}$ each of which is smaller than 30 sq. ft., and each of which is too small to permit a pallet projection 2 ft.×7 ft. to pass therethrough.

In this embodiment, central container support cross-beam 132 has a structural connection fitting in the form of an anchor 160. Anchor 160 functions as a force transfer interface between elongate member 146 and central container support cross-beam 132. Anchor 160 has the form of a plate, such as plate 118, that in this case extends laterally from central container support cross-beam 132. A first end 162 of elongate member 146 is mated to anchor 160, e.g., by welding.

Similarly, a second end 164 of elongate member 146 is mounted to cross-tie 138. Cross-tie 138 is formed from a channel 166 that is mounted toes-down to a plate 168, the two parts cooperating to form a hollow-section beam in which the back of the channel is the top flange, and the plate forms the bottom flange, the top and bottom flanges being joined by the shear webs defined by the legs of the channel. Plate 168 has widened ends that are cut to the profile seen in the figure to define laterally extending wings defining anchors 170 to which respective end 162, 164 of elongate members 142, 144, 146 and 148 are mounted. The cross-section of the cross-tie 138 is of lighter construction than central cross-beam 52 or 132, or of either of end cross-beams 54, 56 or 134, 136, as may be. It is not intended that cross-tie 138, or such other cross-ties as may be noted herein to be capable of supporting container corner loads. In the same manner as central container support cross-beam 132, end container support cross-beams 134 and 136 have centrally located anchors 160 to which the ends of elongate members 146, 148, 152 and 154 are mounted by welding.

The embodiment of FIG. 4 is substantially the same as that of FIG. 3*a*, but in place of elongate members 142-148, floor assembly 40 of car body unit 180 has central container support cross-beam 172, and end container support cross-beams 174 and 176. It also has two spaced apart cross-ties 178 between central container support cross-beam 172 and either of end container support cross-beams 174, 176. Although they need not be equidistant, it is convenient to make the spacing between the cross-beams 174, 176; and cross-ties 178; and cross-beam 172 all the same. There is an array of pair of first and second (i.e., left-hand and right-hand) elongate members 182, 184, 186, 188 that are mounted to extend diagonally, i.e., obliquely, respectively between end bulkhead bottom flange 46 and end container support cross-beam 174, 176; between end container support cross-beam 174, 176 and a first cross-tie 178; between the first cross-tie 178 and the second cross-tie 178; and between the second cross-tie 178 an central container support cross-beam 172. Elongate members 182, 184, 186 and 188 are of hollow rectangular section and are welded in place as struts between the various cross-beams and cross-ties. Each pair form a V-shape. In this embodiment each "V" points toward central container support cross-member 172. In an alternate embodiment, the arrangement could be reversed such that the "V" points toward the end bulkhead. Anchor plates 119 are mounted centrally to the central container support cross-beam 172, the first and second cross-ties 178, and end container support cross-beams 174, 176, as may be, at the point of the "V". Although differing in plan form view, anchor plate 119 of FIG. 4 has substantially the same structural arrangement and web continuity relative to cross-beam 174, 176, or 172, and cross-ties 178, as the case may be, as does previously described plate 118 of FIG. 3*a*. At the splayed end of the "V", end container support cross-beam 174, 176 and cross-ties 178 have an enlarged end on one side to form an attachment mounting interface ear or lug of anchor 170 to which the respective diagonal member is welded in the same manner as previously in respect of plate 118. The elongated members have aspect ratios in the range of 30:1 to 60:1. As before there is no space between the various elements that is greater than 30 sq. ft., and no open area that will allow a projected pallet of 2 ft×7 ft to pass.

The designs of the embodiments of FIGS. 3*a* and 4 provide greater protection than that of FIG. 2 in respect of the floor breakout issue in relation to smaller pallet shapes. That is, the designs of FIGS. 3 and 4 address a smaller pallet size, namely 2.5'×7' pallet size instead of 2'×8'. The truss systems shown and described also meet the two requirements identified above.

Figure 5:
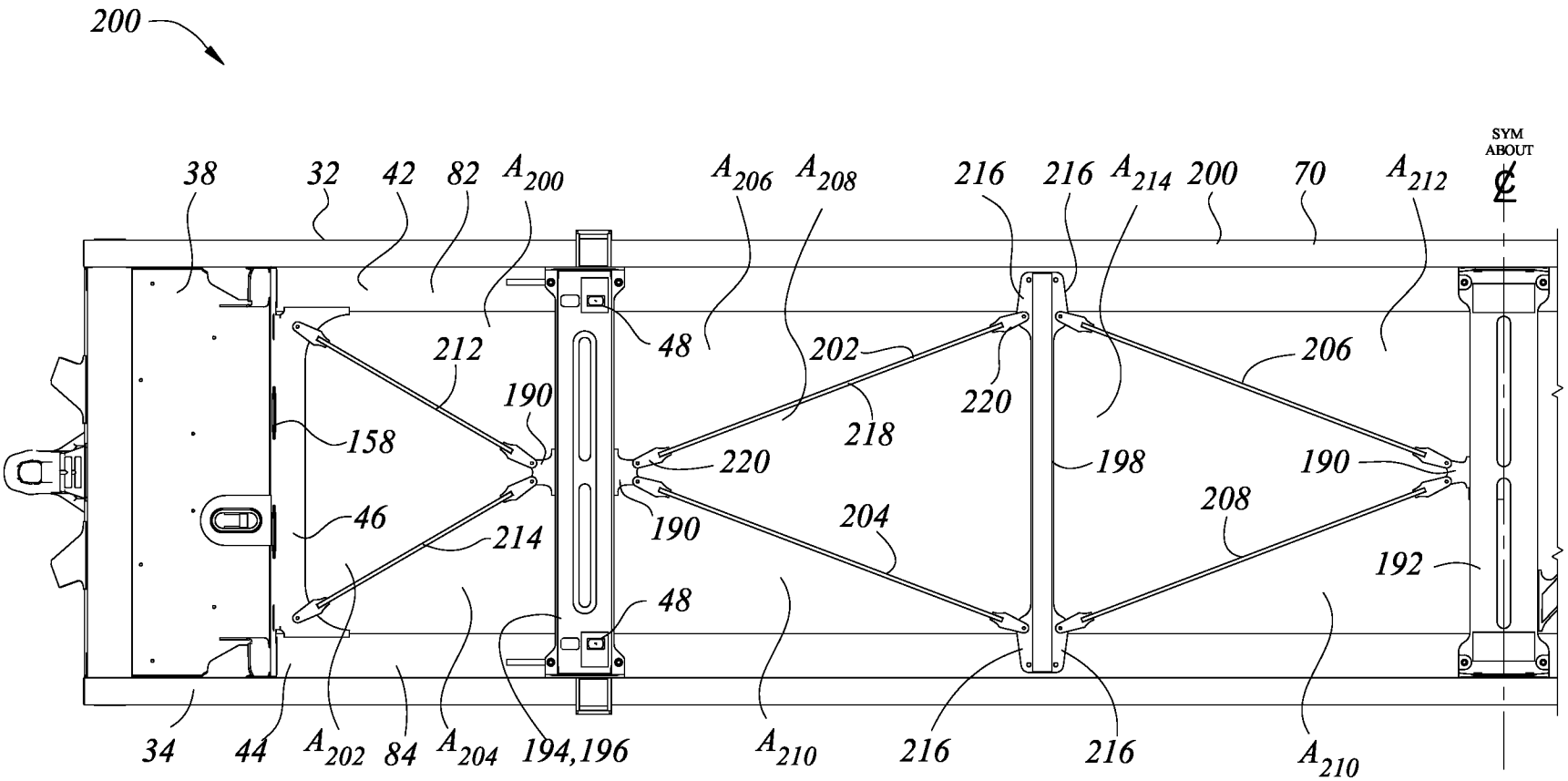
FIG. 5 is a top view of a further alternate railroad well car to that of FIG. 3*a;*

The embodiment of FIG. 5 is similar to that of FIG. 3*a*. Car body unit 200 has central container support cross-beams 192, and end container support cross-beams 194 and 196. It also has a cross-member 198 spaced equally between central container support cross-beam 192 and either of end container support cross-beams 194, 196. In place of elongate members 142, 144, 146, 148, which are hollow structural sections that are welded into position at both ends, car body unit 200 has an array of elongate members 202, 204, 206, 208 that are mounted to extend between various adjacent pairs of central container support cross-beam 192; end cross-beams 194, 196; and cross-members 198. There are also shorter elongate members 212, 214 that extend on the diagonal from the outboard corners of bottom flange 46 of end section bulkhead 158 to the center anchor plate, or simply "anchor" 190 of the longitudinally outboard side of cross-beam 194 or 196 as may be. Further anchors 190 are mounted to the other side (i.e., the longitudinally inboard side) of end cross-members and to both sides of the central cross-member. Although differing in plan form view, anchor 190 has substantially the same structural arrangement and web continuity relative to cross-beams 192, 194, or 196, as may be, as does previously described plate 118. Cross-member 198 is a slim hollow section having a channel section cover on top, welded to a plate on the bottom. The ends of the plate have a widened profile to provide space to bores that accept mechanical fasteners when cross-member 198 is fastened to side sills 42, 44. The widened ends also define anchors 216 to which the associated elongate members are fastened.

Figure 8:
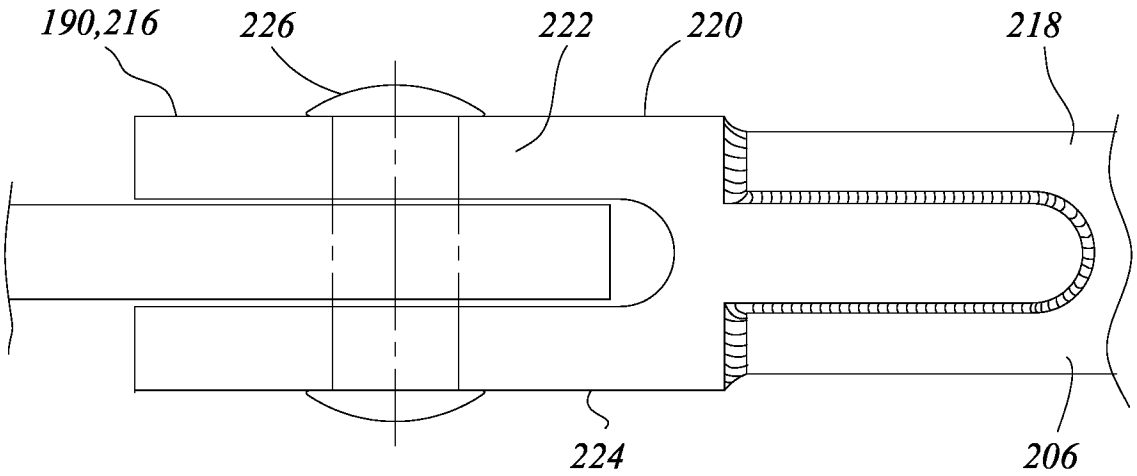
FIG. 8 shows a side view of the mounting fitting of FIG. 7*b*.
Figure 9:
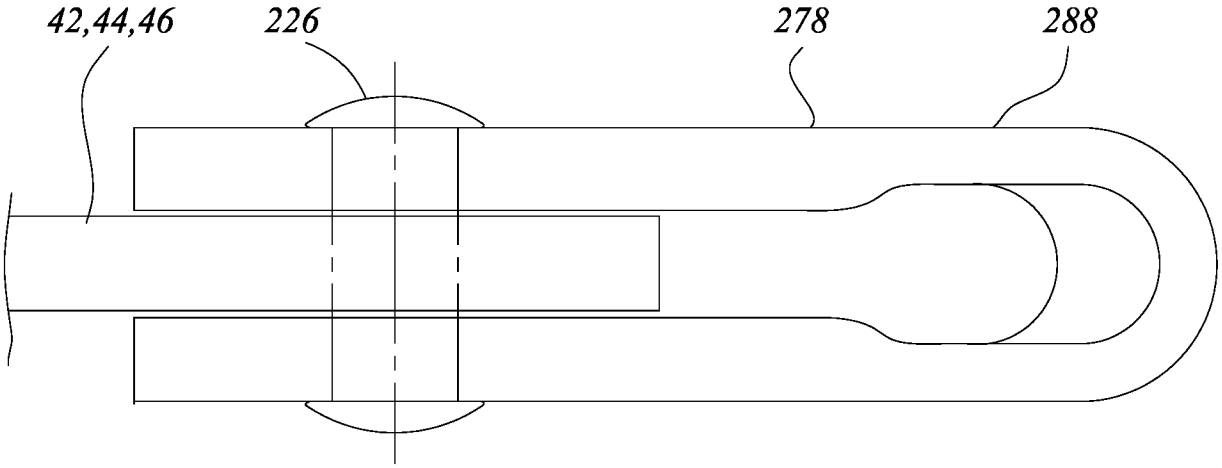
FIG. 9 shows a side view of the mounting fitting of FIG. 7*c.*

Unlike elongate members 142, 144, 146 and 148, elongate members 202, 204, 206, 208, 212 and 214 are not hollow structural sections, but solid rods, of smaller diameter, and may be called tie rods. In some embodiments, including the embodiment shown, elongate members have diameter to length aspect ratios of 1:80 to 1:120. Elongate members 212, 214 have the same diameter, and have aspect ratios corresponding to the difference in their length relative to elongate members 202, 204, 206 and 208. Each elongate member has a main or central portion 218 that is the rod. Each elongate portion also has two opposed end portions 220. As seen in FIG. 8, each end portion 220 includes a clevis 222. Clevis 222 has a widened stem or shank 224. The shank of clevis 222 is welded to rod 218. The clevis is secured to the respective anchors 190 or 216 at either end by a pin 226 that is in double shear at each anchor.

Rather than being a formed section, the elongate members are solid rods 218 that are mounted in tension between the pin-jointed ends (e.g., be squeezing the sides of the car together during assembly, and then releasing the sides after assembly so that the diagonal rods are in tension). As before this divides up the potential bottom opening area of the car into smaller regions $A_{200}$, $A_{202}$, $A_{204}$, $A_{206}$, $A_{208}$, $A_{210}$, $A_{212}$, $A_{214}$ and $A_{216}$ such that there is no space between the various elements that is greater than 30 sq. ft., and no open area will allow a projected pallet of 2 ft×7 ft to pass.

Figure 6:
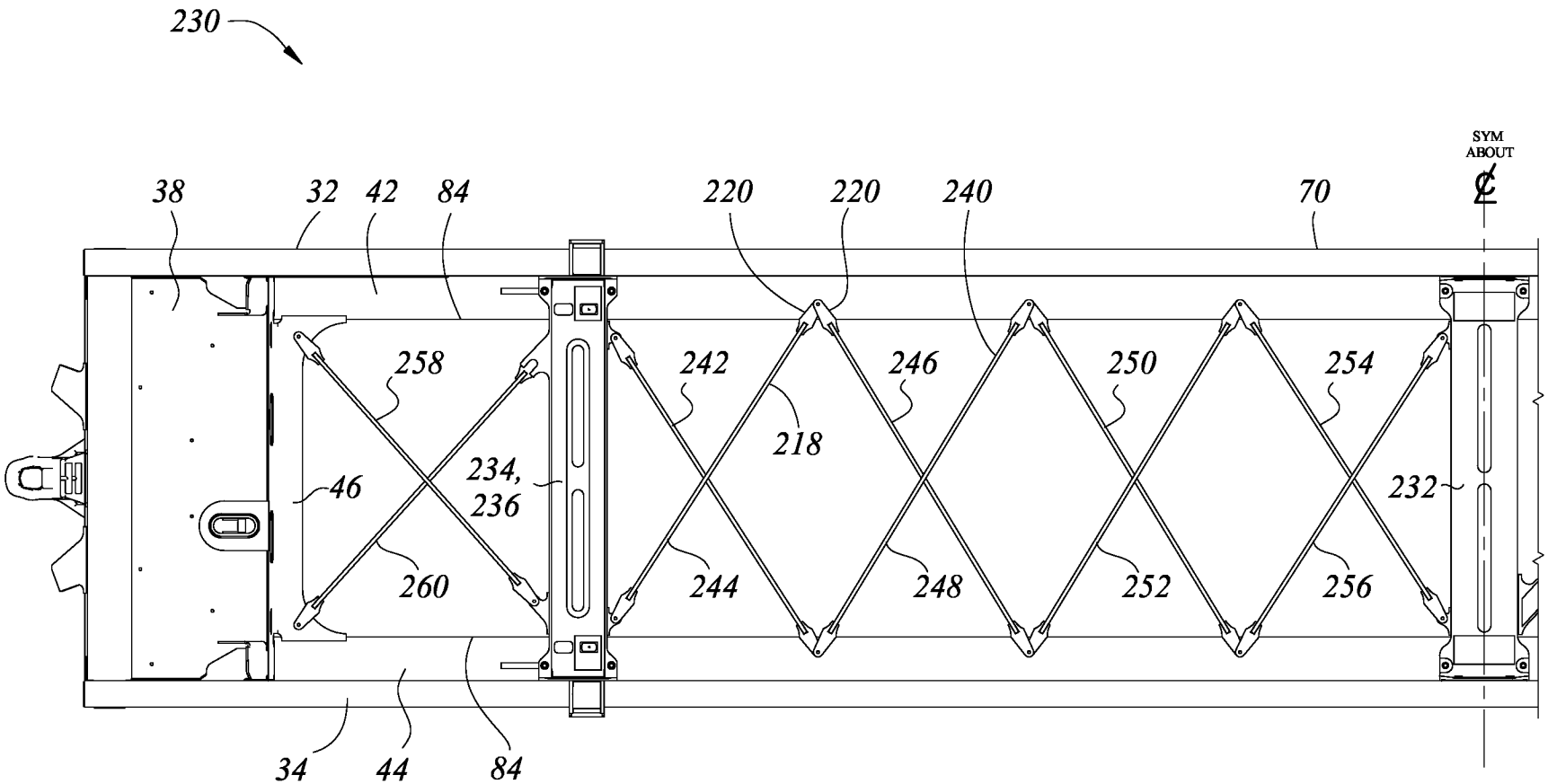
FIG. 6 is a top view of an alternate railroad well car to that of FIG. 3*a;*

In the embodiment of FIG. 6, there is a railroad well car body unit 230 that is free of intermediate cross-ties between the central and end container support cross-beams 232, 234, 236. Those cross-members are free of, i.e., do not have, mid-span anchors such as 118, 170, 119, and so on. Rather car body unit 230 has an array 240 of pin jointed elongate members 242, 244, 246, 248, 250, 252, 254, 256 that have rods 218 of suitable lengths, with end devises 222 and pin-jointed connections, as described above and shown in FIG. 8. These members are installed in a criss-crossing fashion as shown. In this configuration the pin-jointed rods have a criss-crossing pattern along well 30 between center container support cross-beam 232 and one of end container support cross-beams 234, 236 as may be. Another pair of such pin-jointed elongated members 258, 260 extends in a cross arrangement between the outboard corners of end bulkhead bottom flange 46 and cross-beams 234, 236. The pin joints are either formed in bottom flange 46, side sill flanges, i.e., legs 84, or to anchors 216 of container support cross-beams 232, 234, or 236 as may be. As before, anchors 216 may have the form of profiled plates installed in a manner analogous to anchor plate 118, 190, 216, and so on. An X-shaped wear guard may be placed between the rods of the criss-crossing pairs of elongated members where they cross. The guard may be made of, or coated with, polymer. The polymer may be a low friction high molecular weight, high density polymer.

As before the car is assembled by squeezing side beams 32, 34 slightly toward each other to pre-tension elongate members 242, 244, 246, 248, 250, 252, 254, 256, 258 and 260. As before, the criss-crossed pattern of elongate members divides the bottom opening of the railcar body into smaller opening areas, none of which is larger than 30 sq. ft., and none of which is large enough to accommodate a pallet that is 2 ft×7 ft. or larger. In this embodiment, as above, the clearance between side sills 42, 44 is less than 7 ft.

Figure 7A:
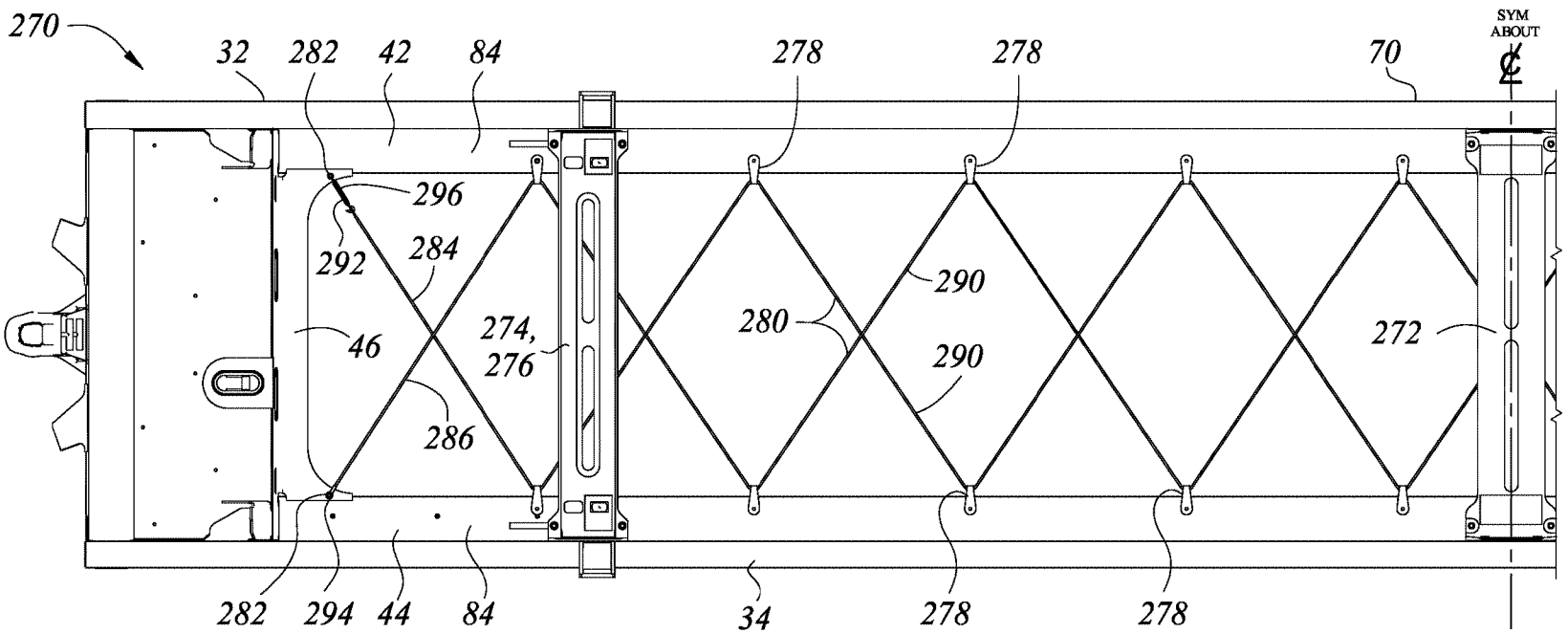
FIG. 7*a* is a top view of an alternate railroad well car to that of FIG. 6.

The embodiment of FIG. 7*a* is similar to the embodiment of FIG. 6 to the extent that it has an array of criss-crossing elongate members that sub-divide the bottom opening area of well 30 into regions that are less than 30 sq. ft. in area and that are to small to permit a pallet that is 2 ft.×7 ft to pass through.

However, in FIG. 7*a*, well car body unit 270 uses flexible elongated members, rather than rigid rods. That is, well car body unit 270 has central and end container support cross-beams 272, 274, and 276, as before. However, car body unit 270 is free of cross-ties and of rigid perpendicular intermediate cross-members. A set of cable engagement brackets or fittings 278 that are spaced along and mounted to the horizontal flanges of side sills 42, 44. There are cable end fitting attachment locations, which function as anchor points 282 located in the laterally outboard corner regions of end section end bulkhead bottom flanges 46. There is a set of cables 280 that includes a first cable assembly 284 and a second cable assembly 286. Each cable assembly 284, 286 includes a cable 290, a first end fitting 292 and a second end fitting 294. One, the other, or both of end fittings 292, 294 may be a tension adjuster, such as a turnbuckle 296. The first end is attached at one of the end corners at one of the corner anchor points 282, for example by being attached with a mechanical fastener. Cable 290 is then fed diagonally across to the next longitudinal eyelet, i.e., that of the nearest fitting 278, through the eyelet, and then back diagonally to the other side of the car body to the next eyelet of a fitting 278, and so on up the length of the car to the far end where the second end fitting 294 is attached to an opposite end anchor point 282 in bottom flange 46 of the far end section bulkhead wall. The other cable assembly is similarly installed in the opposite side fittings and strung on alternating diagonals along the car, criss-crossing the car according to the lengthwise pitch spacings of fittings 278. The length of the well is an integer multiple of the pitch spacings of fittings 278. If it is an even multiple, then the ends of each cable terminate on the same side. If it is an uneven multiple, the ends of each cable terminate on opposite sides of the car in the far diagonal corners. As shown, the number of pitches is 11, so each cable starts on one side of the car body and terminates in the far diagonal corner. In this way, a mesh or net, or network, or web, of criss-crossing cables is formed along the car body, dividing the open bottom area into smaller sub-areas, none of which is greater than 30 sq. ft., and none of which is sufficiently large to permit passage of a pallet that is 2 ft.×7 ft. large or larger. As above, at the locations at which the cables cross each other, there may be a protective separator, such as may be made of, or coated with, a low friction material. Inasmuch as cable assemblies 284, 286 pass underneath center and end container support cross-beams 272, 274, 276, the underside of cross-members 272, 274, 276 may also have a low friction coating or treatment or separator, such as a high density polymer shim or slip.

Fittings 278 may be eyelets or rings, or metal loops. In one embodiment they may have the form of a clasp having upper and lower wings, those wings having bores that align with anchor bores in the side sill, and which are then held in place by fastening hardware. In an alternate form, fitting 278 may have the form of a cable-hanger identified as a rigid fairlead 288 that has a radiused channel, or groove along which the cable feeds, the radius being provided to define the minimum bend radius of the cable. Whether it is called an eyelet, a bollard, a cable-hanger or a fair lead, the fitting functions as a force-transfer interface, or reaction, or anchor at which the cable interacts with other structure, and at which the cable does not transmit a bending moment, i.e., it functions as if it were a pin-jointed connection. In particular, it functions as a pin-jointed connection at which only loads in tension are received, given that it is not possible to push on a rope. When the cable assemblies are installed, and placed in tension, they provide an array of bracing members, or simply bracing, on the diagonals and stiffens the structure.

The concepts of FIGS. 5, 6 and 7*a* use cables and standard steel rods to satisfy the two main well car floor functions. They provide the advantages of lighter weight, reduced welding, and overall generally simplistic design.

In summary, the foregoing description relates to multiple truss systems for railroad well car floors, each of which has different advantages over the existing designs. These approaches can be applied to the 3-unit, 5-unit, and stand alone single-unit railroad well cars after reasonably minor adjustments.

The simplest embodiment, as own in FIG. 3*a*, has as few as 4 diagonal, or oblique, members arranged as shown. This arrangement is comparatively simple, and in some circumstances is suitable for retrofit to existing well cars. This relative simplicity makes it also relatively manufacturing friendly, yields a light-weight design; and meets the applicable AAR requirements. The use of a minimum possible number of cross-members and the light weight are two predominant features of this design.

The second group of embodiments provides more truss members arranged in an optimal manner to meet the AAR and more stringent floor protection requirements. These embodiments are shown in FIGS. 3*a* and 4. Compared to the existing designs, these truss systems provide more protection against falling "pallet shaped objects" in case of a container breakout, while keeping the light weight close to the established design.

Figure 7C:
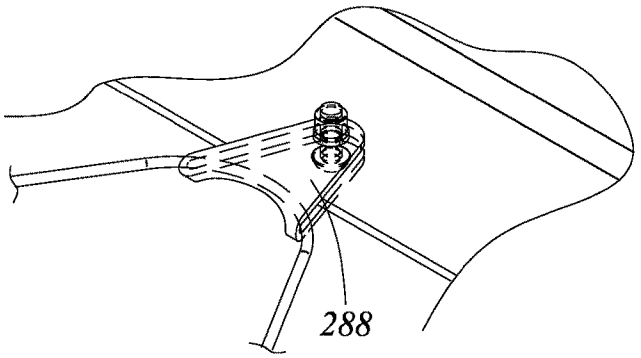
FIG. 7*c* shows an alternate mounting fitting to that of FIG. 7*b;*
Figure 7B:
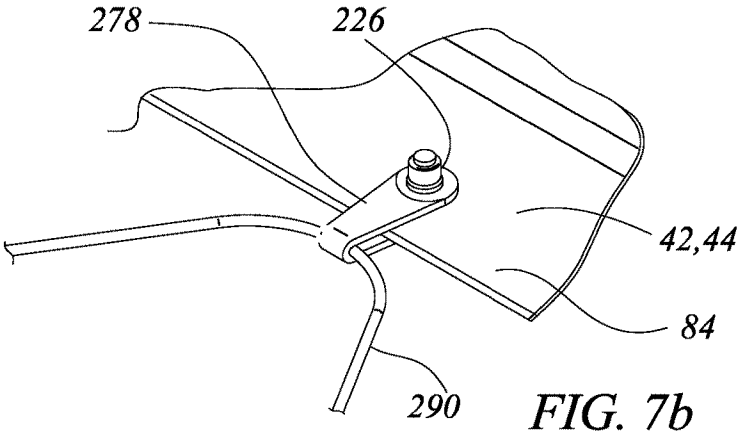
FIG. 7*b* is an enlarged detail of a mounting fitting of the well car of FIG. 7*a;*

The third group of embodiments use standard steel rods in place of HSS (hollow structural section) or fabricated tubes for some portions (or the entire) floor. These embodiments are shown in FIGS. 5, 6 and 7*a*. These truss systems exceed the AAR requirements while offering improvements in manufacturing ease and light weight. The rods are connected to the side beam construction, in the form of connection to the horizontal flanges of the respective side sills and ends section bulkhead flanges, employing a combination of welded and bolted tie plates. Some of the features could be pre-stressed members, and hinged joints at the attachment points to the side sill. In the examples of FIGS. 3, 4, and 5, the size of the larger triangular openings is less than 30 sq. ft., and the smaller triangles, have the same altitude and half the base, is less than 15 sq. ft. In the example of FIGS. 6 and 7, the end regions are divided into four parts, each of them being less than 10 sq. ft. In the region between the container support cross-beams, the small triangular openings have an area of less than 10 sq. ft.; the diamond-shaped openings have an area less than 15 sq. ft.

Except for the heavy option of FIG. 4, all examples require less welding than an existing design. Manufacturing is also eased by use of subassemblies that are easier to handle. The examples of FIGS. 3*a*, 4, 5, 6 and 7*a* may also enhance the symmetry of the railcar design relative to the longitudinal center line. The examples of FIGS. 2, 3*a*, 5, 6 and 7*a* are expected to reduce the weight, manufacturing cost, and overall cost.

The inventors have provided new railroad well car floor truss arrangements. The inventors have switched to an all diagonal members arrangement to handle the shear effect on the well car body. Compared to an all transverse members floor, this layout tends to reduce the bending moment on the members and hence permit the use of lighter connections, yet while all being arranged diagonally (no lateral cross-members), they still provide the stiffness needed for the lateral loads.

Various embodiments have been described in detail. Since changes in and or additions to the above-described examples may be made without departing from the nature, spirit or scope of the invention, the invention is not to be limited to those details but only by a purposive reading of the claims as required by law. As may be understood without further multiplication and repetition of description, the various features of the several embodiments may be mixed and matched as appropriate.

What is claimed is:

1. A railroad well car body unit comprising:

a pair of first and second side beams, said side beams extending lengthwise between first and second railcar end sections mounted to railcars trucks for rolling motion in a longitudinal direction along railroad car tracks;

said railroad well car body unit having a well defined between said side beams and said end sections;

first and second container support cross-beams extending cross-wise between and mounted at moment connections to said first and second side beams;

an intermediate container support cross-beam located between and spaced from said first and second container support cross-beam;

said first and second container support cross-beams having container indexing fittings upon which to locate shipping containers;

bracing of said well of said railroad well car body unit mounted along said well car body unit between said side beams, said bracing including an array of elongate members, said elongate members including obliquely extending tension members; and said tension members include cables.

2. The railroad well car body unit of claim 1 wherein:

said first and second container support cross-beams each have a respective uppermost surface upon which to seat a shipping container;

said first tension member has an uppermost extremity; and said uppermost extremity of said first tension member lies at a lower height than said respective uppermost surfaces of said first and second cross-beams.

3. The railroad well car body unit of claim 1 wherein said cables are pre-tensioned.

4. The railroad well car body unit of claim 1 wherein:

said first and second container support cross-beams each have a respective uppermost surface upon which to seat a shipping container;

said bracing has an uppermost height; and said uppermost height of said bracing lies at a lower height than do said respective uppermost surfaces of said first and second cross-beams.

5. The railroad well car body unit of claim 1 wherein said railroad well car is free of cross-ties.

6. The railroad well car body unit of claim 1 wherein said first and second container support cross-beams are mounted to said first and second side beams at moment connections.

7. The railroad well car body unit of claim 1 wherein said first container support cross-beam has a vertical through-thickness; said bracing has a vertical through-thickness; and said vertical through-thickness of said bracing is less than said vertical through-thickness of said first container support cross-beam.

8. The railroad well car body unit of claim 1 wherein said well car body unit has an open bottom and said bracing is spaced along said body unit and limits opening passages through said open bottom to under 30 sq. ft.

9. The railroad well car body unit of claim 1 wherein said well car body unit has an open bottom and said bracing limit opening passages through said open bottom to obstruct any object having dimensions greater than 2½ ft×7 ft.

10. A railroad well car body unit comprising:

a pair of first and second side beams, said side beams extending lengthwise between first and second railcar end sections mounted to railcars trucks for rolling motion in a longitudinal direction along railroad car tracks;

said railroad well car having a well defined between said side beams and said end sections;

first and second container support cross-beams extending cross-wise between said first and second side beams;

an intermediate container support cross-beam located between and spaced from said first and second container support cross-beam; and cross-bracing mounted along said well car body between said side beams, said cross-bracing including an array of elongate members extending in an obliquely angled criss-crossing pattern along said well;

said elongate members including obliquely extending tension members; and said tension members including one of (a) cables; and (b) tension rods having pin-jointed ends; and there being at a first criss-crossing of said elongate members between said first container support cross-beam and said intermediate container support cross-beam; and a second criss-crossing of said elongate members between said second container support cross-member and said intermediate container support cross-member.

11. The railroad well car body unit of claim 10 wherein said tension members are said solid rods.

12. The railroad well car body unit of claim 10 wherein said cables are pre-tensioned.

13. The railroad well car body unit of claim 10 wherein said railroad well car is free of cross-ties.

14. The railroad well car body unit of claim 10 wherein said first and second container support cross-beams are mounted to said first and second side beams at moment connections.

15. The railroad well car body unit of claim 10 wherein said first container support cross-beam has a vertical through-thickness; said bracing has a vertical through-thickness; and said vertical through-thickness of said bracing is less than said vertical through-thickness of said first container support cross-beam.

16. The railroad well car body unit of claim 10 wherein said well car body unit has an open bottom and said bracing is spaced along said body unit and limits opening passages through said open bottom to under 30 sq. ft.

17. The railroad well car body unit of claim 10 wherein said well car body unit has an open bottom and said bracing limit opening passages through said open bottom to obstruct any object having dimensions greater than 2½ ft×7 ft.

18. A railroad well car body unit comprising:

a pair of first and second side beams, said side beams extending lengthwise between first and second railcar end sections mounted to railcars trucks for rolling motion in a longitudinal direction along railroad car tracks;

said railroad well car body unit having a well defined between said side beams and said end sections;

first and second container support cross-beams extending cross-wise between and mounted at moment connections to said first and second side beams;

an intermediate container support cross-beam located between and spaced from said first and second container support cross-beam;

said first and second container support cross-beams having container indexing fittings upon which to locate shipping containers;

bracing of said well of said railroad well car body unit mounted along said well car body unit between said side beams, said bracing including an array of elongate members, said elongate members including obliquely extending tension members; and said tension members including cables; and said cables are strung back and forth across said well between a set of fairleads mounted to said side beams.

19. A railroad well car body unit comprising:

a pair of first and second side beams, said side beams extending lengthwise between first and second railcar end sections mounted to railcars trucks for rolling motion in a longitudinal direction along railroad car tracks;

said railroad well car body unit having a well defined between said side beams and said end sections;

first and second container support cross-beams extending cross-wise between and mounted at moment connections to said first and second side beams;

an intermediate container support cross-beam located between and spaced from said first and second container support cross-beam;

said first and second container support cross-beams having container indexing fittings upon which to locate shipping containers;

bracing of said well of said railroad well car body unit mounted along said well car body unit between said side beams, said bracing including an array of elongate members, said elongate members including obliquely extending tension members; and said tension members including cables; and at least one of said cables passes under said first container support cross-beam.

20. A railroad well car body unit comprising:

a pair of first and second side beams, said side beams extending lengthwise between first and second railcar end sections mounted to railcars trucks for rolling motion in a longitudinal direction along railroad car tracks;

said railroad well car body unit having a well defined between said side beams and said end sections;

first and second container support cross-beams extending cross-wise between and mounted at moment connections to said first and second side beams;

an intermediate container support cross-beam located between and spaced from said first and second container support cross-beam;

said first and second container support cross-beams having container indexing fittings upon which to locate shipping containers;

bracing of said well of said railroad well car body unit mounted along said well car body unit between said side beams, said bracing including an array of elongate members, said elongate members including obliquely extending tension members;

said tension members including one of (a) cables; and (b) tension rods having pin-jointed ends; and said tension members are mounted in a criss-crossing arrangement between said first container support cross-member and said intermediate container support cross-member, and between said second container support cross-member and said intermediate container support cross-member.

21. The railroad well car body unit of claim 20 wherein said tension members are said solid rods.

22. The railroad well car body unit of claim 20 wherein said tension members include said cables.

23. The railroad well car body unit of claim 20 wherein one of:

(a) said tension members are said rods, and said rods are pre-tensioned; and (b) said tension members are said cables, and said cables are pre-tensioned.

24. The railroad well car body unit of claim 20 wherein said railroad well car is free of cross-ties.

25. The railroad well car body unit of claim 20 wherein said first and second container support cross-beams are mounted to said first and second side beams at moment connections.

26. The railroad well car body unit of claim 20 wherein said first container support cross-beam has a vertical through-thickness; said bracing has a vertical through-thickness; and said vertical through-thickness of said bracing is less than said vertical through-thickness of said first container support cross-beam.

27. The railroad well car body unit of claim 20 wherein said well car body unit has an open bottom and said bracing is spaced along said body unit and limits opening passages through said open bottom to under 30 sq. ft.

28. The railroad well car body unit of claim 20 wherein said well car body unit has an open bottom and said bracing limit opening passages through said open bottom to obstruct any object having dimensions greater than 2½ ft×7 ft.

* * * * *